US011685492B2

(12) United States Patent
Schmidt et al.

(10) Patent No.: US 11,685,492 B2
(45) Date of Patent: Jun. 27, 2023

(54) PROPULSION ENHANCING DEVICE AND WATERCRAFT COMPRISING SAME

(71) Applicant: Vortex Pipe Systems LLC, Austin, TX (US)

(72) Inventors: Paul Wayne Schmidt, Carlton, OR (US); Avijit Ghosh, Austin, TX (US)

(73) Assignee: Vortex Pipe Systems LLC, Austin, TX (US)

( * ) Notice: Subject to any disclaimer, the term of this patent is extended or adjusted under 35 U.S.C. 154(b) by 48 days.

(21) Appl. No.: 17/407,753

(22) Filed: Aug. 20, 2021

(65) Prior Publication Data

US 2022/0306254 A1 Sep. 29, 2022

Related U.S. Application Data

(63) Continuation of application No. 17/314,385, filed on May 7, 2021, now Pat. No. 11,247,758.

(60) Provisional application No. 63/165,162, filed on Mar. 24, 2021.

(51) Int. Cl.
*B63H 1/16* (2006.01)

(52) U.S. Cl.
CPC ..... *B63H 1/16* (2013.01)

(58) Field of Classification Search
CPC ..... B63H 1/00; B63H 1/16
USPC ..... 440/66, 67
See application file for complete search history.

(56) References Cited

U.S. PATENT DOCUMENTS 11,247,758 B1 * 2/2022 Schmidt ..... B63H 1/16

* cited by examiner

*Primary Examiner* — Lars A Olson
(74) *Attorney, Agent, or Firm* — David O. Simmons; IVC Patent Agency

(57) ABSTRACT

Embodiments of the present invention are directed to devices adapted to enhance propulsion (i.e., propulsion enhancing devices) of watercraft such as, for example, personal watercraft and the like. To this end, a propulsion enhancing device in accordance with the disclosures made herein may be attached to or integral with (e.g., formed unitarily with a housing thereof) a propulsion unit of a watercraft. The propulsion unit generates a stream of water that provides for propulsion of the watercraft. A propulsion enhancing device in accordance with the disclosures made herein includes internal structures that enhance velocity and/or volumetric attributes of a stream of water generated by the propulsion unit by transforming non rotational flow at the inlet of the propulsion enhancing device to rotational flow at the outlet of the propulsion enhancing device.

20 Claims, 5 Drawing Sheets

PROPULSION ENHANCING DEVICE AND WATERCRAFT COMPRISING SAME

CROSS-REFERENCE TO RELATED APPLICATIONS

This patent application claims priority as a continuation to co-pending U.S. Non-provisional patent application having Ser. No. 17/314,385, filed 7 May 2021, entitled "PROPULSION ENHANCING DEVICE AND WATERCRAFT COMPRISING SAME," which claims priority to from U.S. Provisional Patent Application having Ser. No. 63/165,162, filed 24 Mar. 2021, entitled "PROPULSION ENHANCING DEVICE AND WATERCRAFT COMPRISING SAME," having a common applicant herewith and being incorporated herein in its entirety by reference.

FIELD OF THE DISCLOSURE

The disclosures made herein relate generally to fluid flow modifying devices and, more particularly, to devices adapted to enhance propulsion of watercraft.

BACKGROUND

Watercraft (e.g., a personal recreational watercraft) that provide for propulsion through creation of one or more streams of water exhibiting high volumetric flow rate are well known. Through use of an engine or motor of a watercraft to drive a pump connected to the engine or motor, inlet water to the pump is acted on by the pump (e.g., an impeller thereof) to create a stream of water that exhibits both relatively high velocity and relatively high volume. Such stream of water exhibiting high volumetric flow rate is delivered into the water body within which the watercraft resides to propel the watercraft in a forward direction. Some watercrafts include a flow diverting vanes that redirects all or a portion of the stream of water in a direction that propels the watercraft in a direction other than the forward direction—e.g., in a rearward direction relative to the forward direction.

Velocity and volumetric attributes of the stream of water largely dictate the overall performance of a watercraft. Examples of such performance include, but are not limited to, acceleration from a standing start, acceleration from one moving speed to a greater moving speed, and an attainable top speed. Thus, devices adapted to improve propulsion of a watercraft by enhancing velocity and/or volumetric attributes of a stream of water created by a propulsion unit of the watercraft would be advantageous, desirable and useful.

SUMMARY OF THE DISCLOSURE

Embodiments of the present invention are directed to devices adapted to enhance propulsion (i.e., propulsion enhancing devices) of watercraft such as, for example, personal watercraft and the like. To this end, a propulsion enhancing device in accordance with the disclosures made herein may be attached to or integral with (e.g., formed unitarily with a housing thereof) a propulsion unit of a watercraft. The propulsion unit generates a stream of water that provides for propulsion of the watercraft. A propulsion enhancing device in accordance with the disclosures made herein includes internal structures that advantageously enhance velocity and/or volumetric attributes of a stream of water generated by the propulsion unit to thereby enhance performance (e.g., acceleration and/or speed) of the watercraft.

In one or more embodiments of the disclosures made herein, a propulsion enhancing device comprises a flow expander, a vortex flow generator and a plurality of stabilizer fins. The vortex flow generator has therein a plurality of helical flow passages jointly defined by an exterior tubular body of the vortex flow generator, a central tube of the vortex flow generator and adjacent ones of a plurality of flow diverting vanes of the vortex flow generator. An upstream end portion of the exterior tubular body extends from a downstream end portion of the flow expander. Each of the flow diverting vanes extends in a helical manner from a first end portion thereof proximate the flow expander to a second end portion thereof proximate a downstream end portion of the exterior tubular body. The exterior tubular body tapers from a largest cross-sectional size adjacent the upstream end portion thereof to a smallest cross-sectional size adjacent the downstream end portion thereof. Each of the flow diverting vanes is attached to at least one of the exterior tubular body and the central tube. A downstream end of the central tube is located upstream of the downstream end portion of the exterior tubular body. The plurality of stabilizer fins each extend outwardly from an exterior surface of the exterior tubular body.

A propulsion enhancing device comprises a flow expander, a vortex chamber body, a plurality of flow diverting vanes, a central tube and a plurality of stabilizer fins. The vortex chamber body is in fluid communication with the flow expander for forming a fluid flow path therethrough. An upstream end portion of the vortex chamber body extends from a downstream end portion of the flow expander. A downstream end portion of the vortex chamber body defines a fluid flow outlet of the propulsion enhancing device. The plurality of stabilizer fins each extend outwardly from an exterior surface of the vortex chamber body. The plurality of flow diverting vanes are within the vortex chamber body and extend in a helical manner from a first end portion thereof proximate the flow expander to a second end portion thereof proximate a downstream end portion of the vortex chamber body. Each of the flow diverting vanes is tapered to have a largest effective outside diameter proximate the flow expander and a smallest effective outside diameter proximate the downstream end portion of the vortex chamber body. A central tube is within the vortex chamber body. A downstream end of the central tube is located upstream of the fluid flow outlet of the propulsion device. A portion of each of the flow diverting vanes is attached to an interior surface of the vortex chamber body and a portion of each of the flow diverting vanes is attached to an exterior surface of the central tube to thereby provide a plurality of fluid flow passages each jointly defined by respective adjacent ones of the flow diverting vanes, the vortex chamber body and the central tube.

These and other objects, embodiments, advantages and/or distinctions of the present invention will become readily apparent upon further review of the following specification, associated drawings and appended claims.

DETAILED DESCRIPTION

Figure 1:
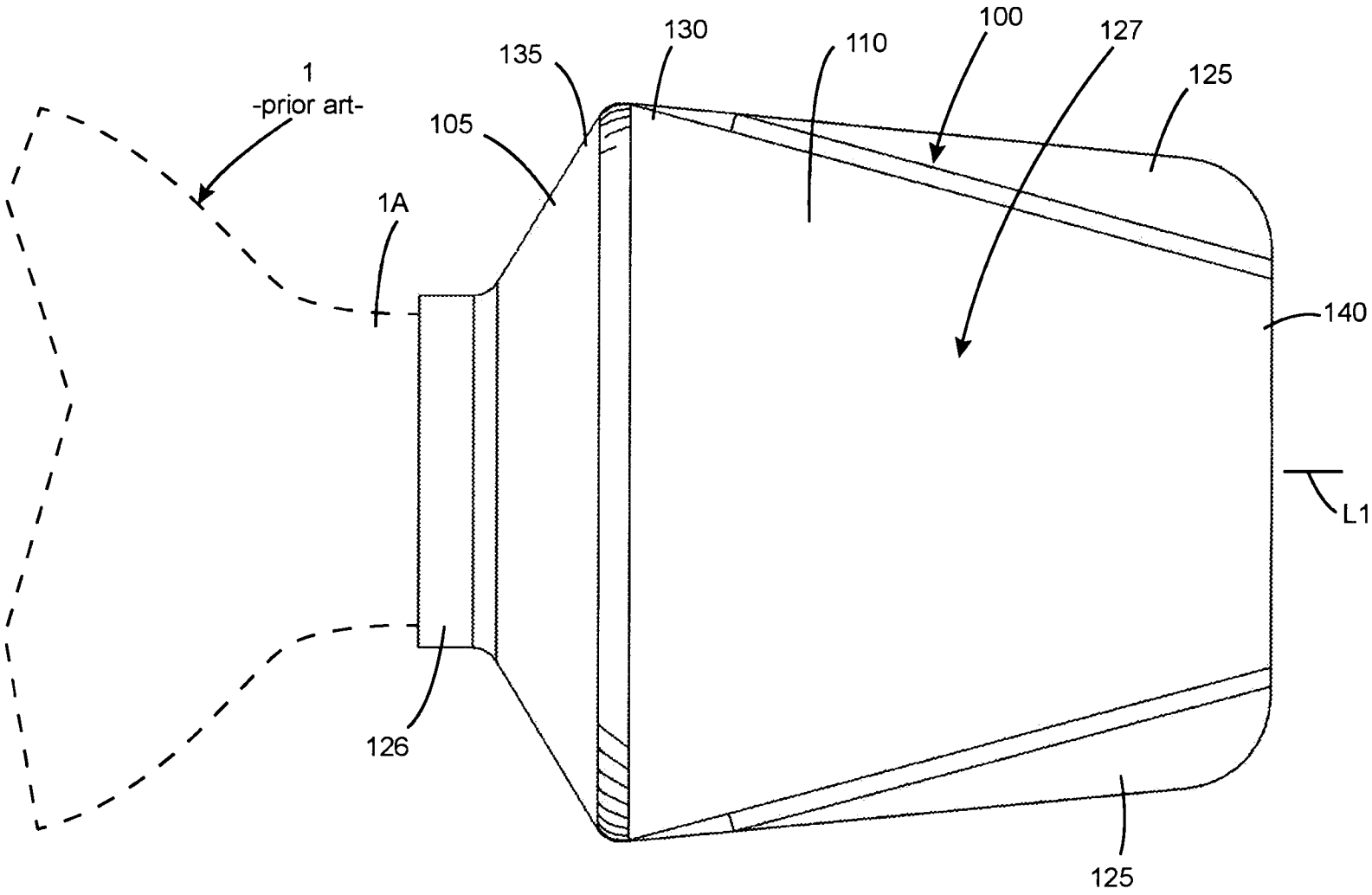
FIG. 1 is a top view of a propulsion enhancing device in accordance with one or more embodiments of the disclosures made herein.
Figure 2:
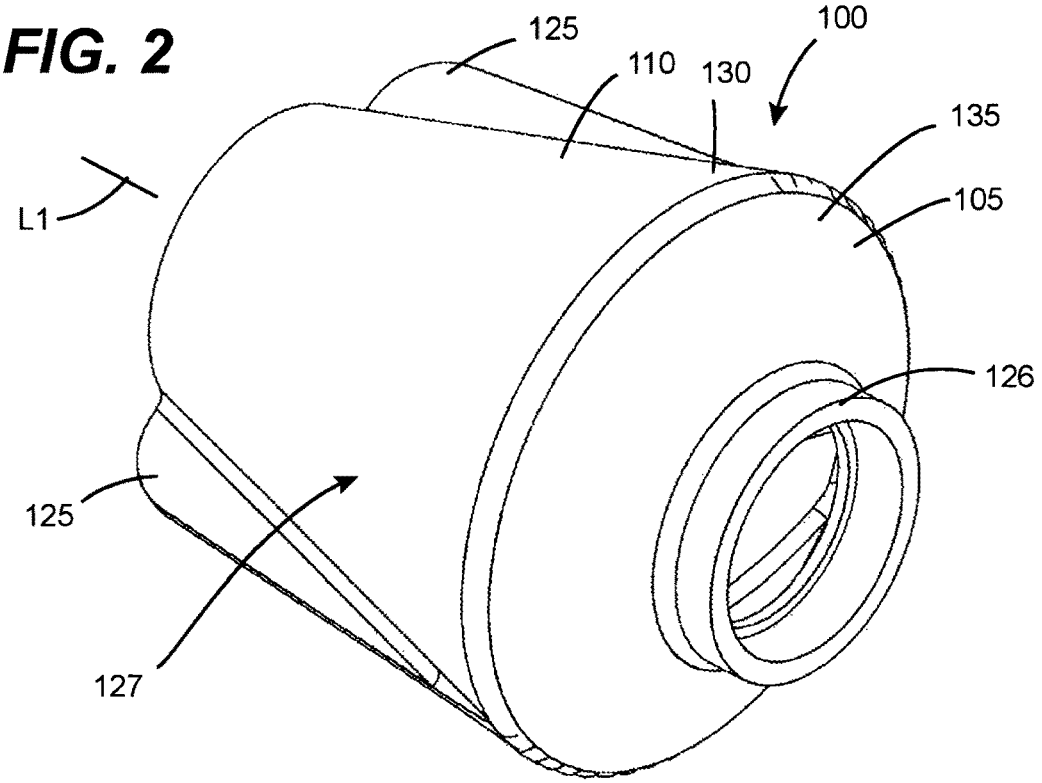
FIG. 2 is a first perspective view of the propulsion enhancing device shown in FIG. 1.
Figure 3:
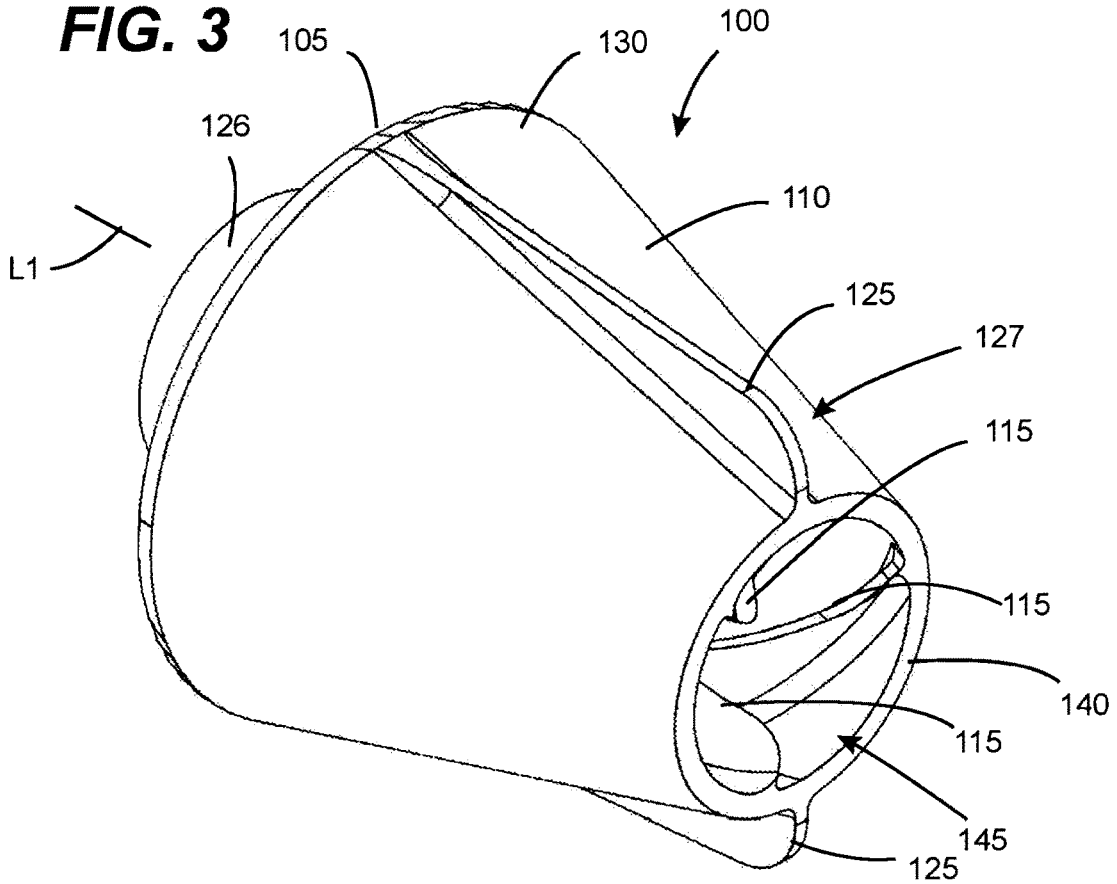
FIG. 3 is a second perspective view of the propulsion enhancing device shown in FIG. 1.
Figure 4:
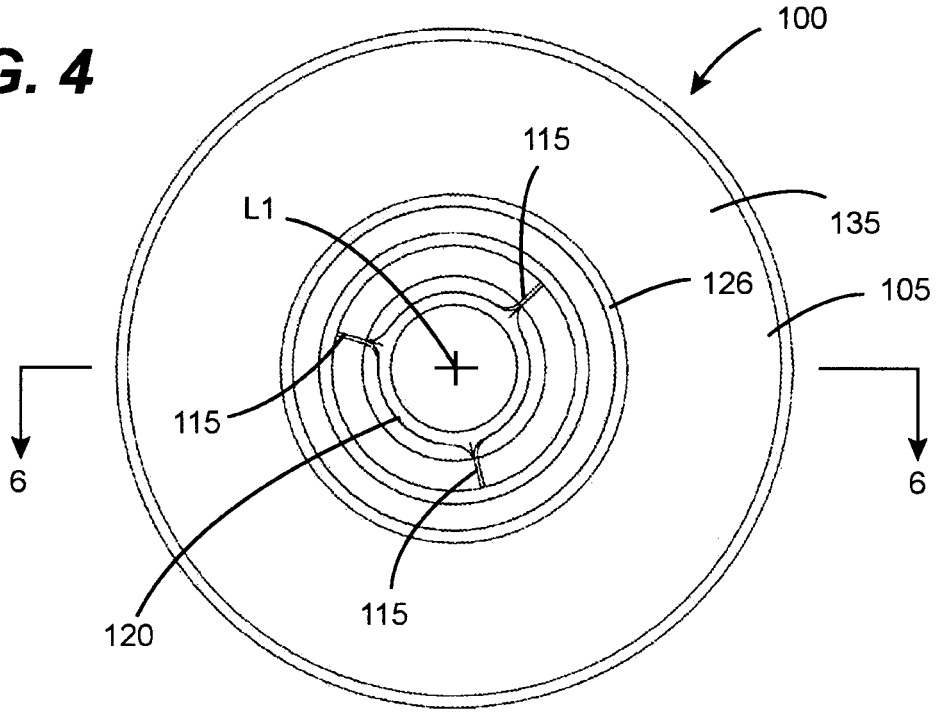
FIG. 4 is an inlet end view of the propulsion enhancing device shown in FIG. 1.
Figure 5:
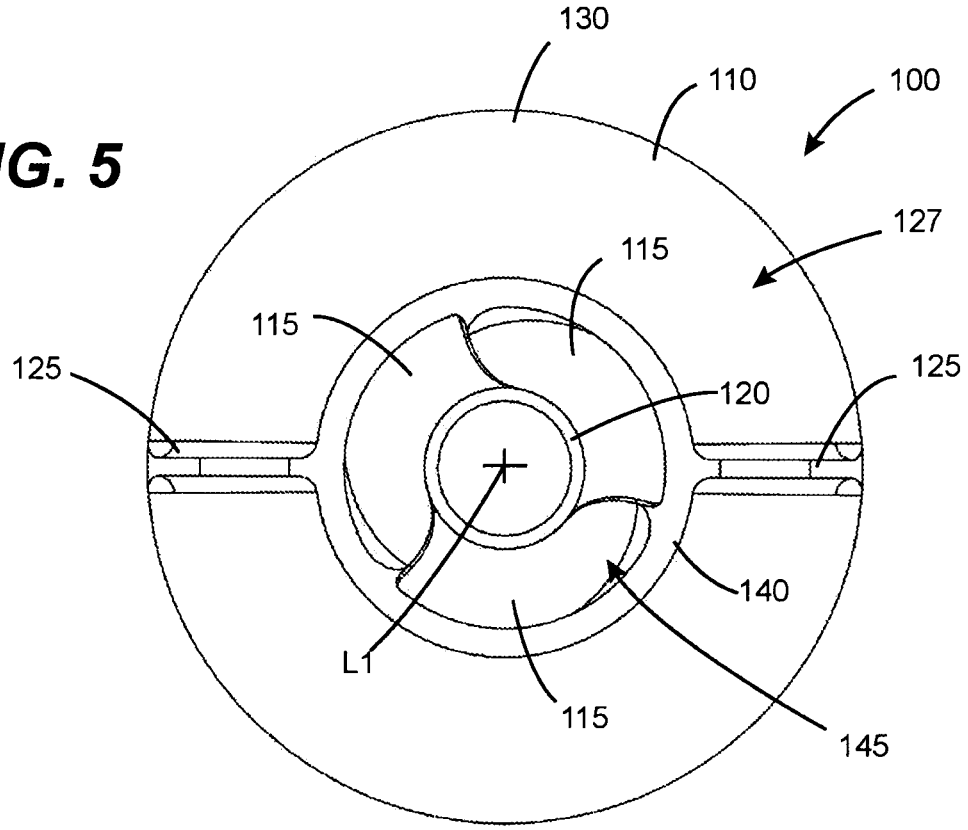
FIG. 5 is an outlet end view of the propulsion enhancing device shown in FIG. 1.

Referring to FIGS. 1-6, a propulsion enhancing device 100 in accordance with one or more embodiments of the disclosures made herein is shown. The propulsion enhancing device 100 is attached a watercraft propulsion unit 1 at the water outlet 1A thereof. The watercraft propulsion unit 1 includes a water pressurizing device (e.g., a pump having an impeller) that receives water at an inlet thereof (not shown), pressurizes such water and outputs a pressurized stream of water at the water outlet 1A. As discussed below in detail, the pressurized water outputted at the water outlet 1A is received by the propulsion enhancing device 100. Advantageously, the propulsion enhancing device 100 include internal structures that enhance velocity and/or volumetric attributes of the pressurized stream of water to thereby enhance performance (e.g., acceleration and/or speed) of a watercraft comprising the watercraft propulsion unit 1.

The propulsion enhancing device 100 comprises a flow expander 105, a vortex chamber body 110, a plurality of flow diverting vanes 115, a central tube 120 and a plurality of stabilizer fins 125. The fluid flow expander 105 includes an inlet tube 126 adapted for being engaged with a mating outlet portion of the watercraft propulsion unit 1. The vortex chamber body 110 is in fluid communication with the flow expander 105 for forming a fluid flow path therethrough. The vortex chamber body 110, the plurality of flow diverting vanes 115 and the central tube 120 jointly define a vortex flow generator 127. The vortex chamber body 110 is an exterior tubular body of the vortex flow generator 127. An upstream end portion 130 of the vortex chamber body 110 extends from a downstream end portion 135 of the flow expander 105. A downstream end portion 140 of the vortex chamber body 110 defines a fluid flow outlet 145 of the propulsion enhancing device 100.

Figure 6:
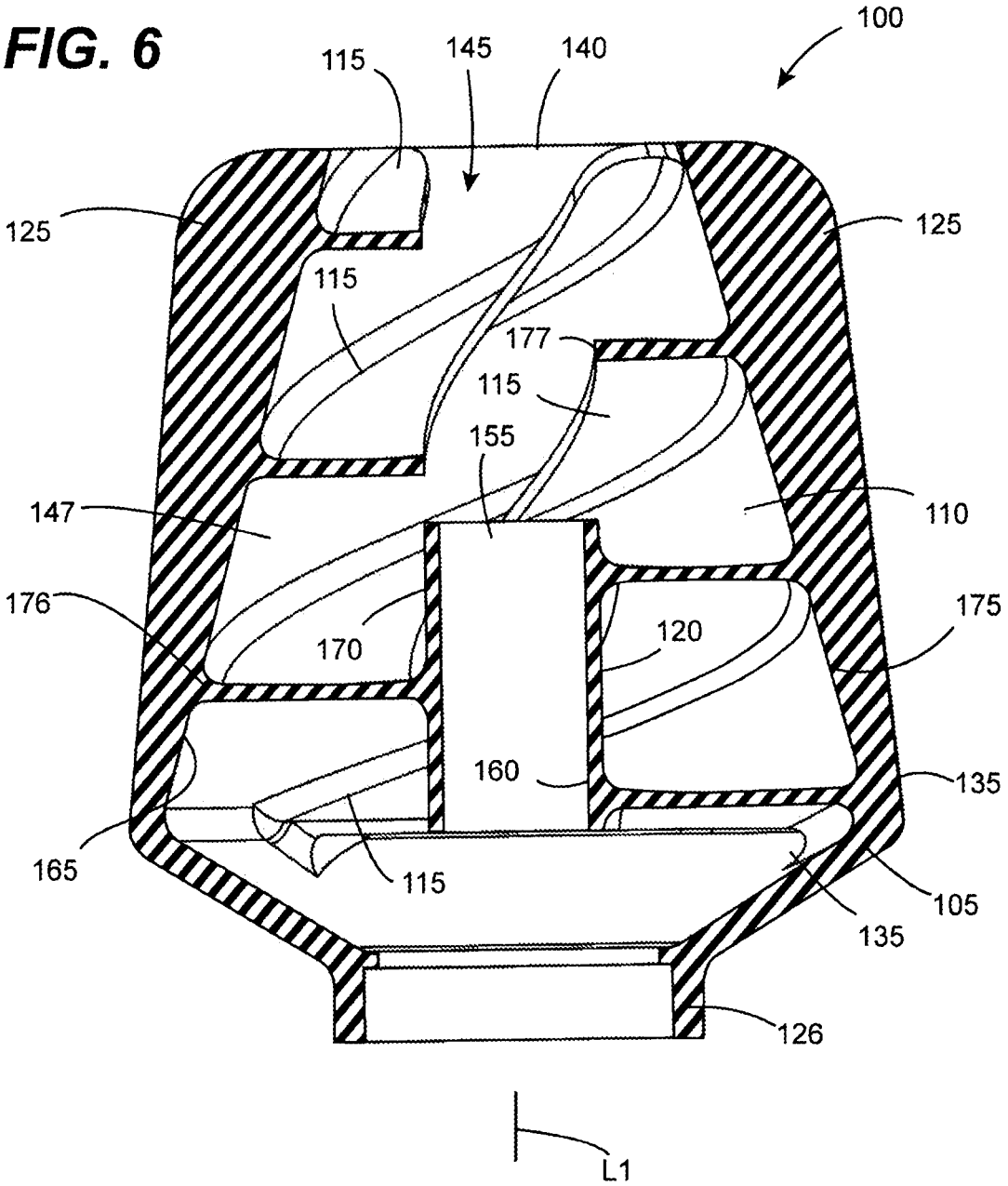
FIG. 6 is a cross-sectional view taken along the line 6-6 in FIG. 4.

Referring to FIG. 6, the plurality of flow diverting vanes 115 are within an interior space 147 of the vortex chamber body 110. Each of the flow diverting vanes 115 extends in a helical manner from a first end portion thereof proximate the flow expander 105 to a second end portion thereof proximate the downstream end portion 140 of the vortex chamber body 110. The central tube 120 is within the interior space 147 of the vortex chamber body 110. A downstream end 155 of the central tube 120 is located upstream of the fluid flow outlet 145 of the propulsion device 100 (i.e., of the vortex flow generator 127). Preferably, the downstream end 155 of the central tube 120 is located entirely within the interior space 147 of the vortex chamber body 110.

A portion of each of the flow diverting vanes 115 may be attached to an interior surface 165 of the vortex chamber body 110 and a portion of each of the flow diverting vanes 115 may be attached to an exterior surface 170 of the central tube 120. Less than all of the flow diverting vanes 115 may be attached to the interior surface 165 of the vortex chamber body 110 and less than all of the flow diverting vanes 115 may be attached to an exterior surface 170 of the central tube 120. A plurality of fluid flow passages 175 are jointly defined by respective adjacent ones of the flow diverting vanes 115, the vortex chamber body 110 and the central tube 120. Three fluid flow passages 175 are shown, but in one or more other embodiments, fewer than three or more than three fluid flow passages 175 may be provided. In preferred embodiments, each of the flow diverting vanes 115 may helically extend around the centerline longitudinal axis L1 by about 360 degrees. In other embodiments, each of the flow diverting vanes 115 may helically extend around the centerline longitudinal axis L1 by significantly more than 360 degrees (e.g., 540 degrees) or significantly less than 360 degrees (e.g., 270 degrees).

Each of the flow diverting vanes 115 is tapered at an exterior edge portion 176 to have a largest effective outside diameter proximate the flow expander 105 and a smallest effective outside diameter proximate the downstream end portion 140 of the vortex chamber body 110. The flow diverting vanes 115 being tapered may arise from the vortex chamber body 110 having an interior surface that is tapered—e.g., the vortex chamber body 110 being a conically shaped tubular body. Each of the flow diverting vanes 115 preferably has an interior edge portion 177 exhibiting a uniform effective inside diameter over an entire length thereof. Each of the flow diverting vanes 115 preferably extends along an entire length of the vortex chamber body 110.

The central tube 120 preferably has a uniform inside diameter over an entire length thereof. The central tube 120 preferably has a generally uniform wall thickness over the entire length thereof. The central tube 120 preferably has an overall length not greater than about half the overall length of the vortex chamber body 110. In one or more embodiments, a terminal end face of the central tube 120 is spaced away from a terminal end face of the vortex chamber body 110 toward the upstream end portion 130 of the vortex chamber body 110 by not less than a distance about equal to the overall length of the central tube 120.

The plurality of stabilizer fins 125 each extend outwardly from an exterior surface of the vortex chamber body 110. Each of the stabilizer fins 125 preferably has a longitudinal axis extending parallel with a centerline reference axis L1 of the vortex chamber body 110. Each of the stabilizer fins 125 is preferably equally spaced away from each adjacent one of the stabilizer fins 125. Each of the stabilizer fins 125 preferably extends an entire length of the vortex chamber body 110. As shown, the propulsion enhancing device 100 has two stabilizer fins 125 (e.g., tapered leveler fins) that are rotationally spaced apart from each other by 180-degrees. A propulsion enhancing device in accordance with one or more embodiments of the disclosure made herein may have more than two stabilizer fins 125. When the propulsion enhancing device 100 is installed, the stabilizer fins 125 are parallel to the surface of a body of water on which a watercraft comprising the propulsion enhancing device 100 rests. The stabilizer fins 125 perform at least two functions: (1) they direct the water in a straight stream around the attachment which eliminates drag and (2) they also stabilize the watercraft to reduce unrestricted motion resulting from propulsion thrust (e.g., side motion lift).

Figure 7:
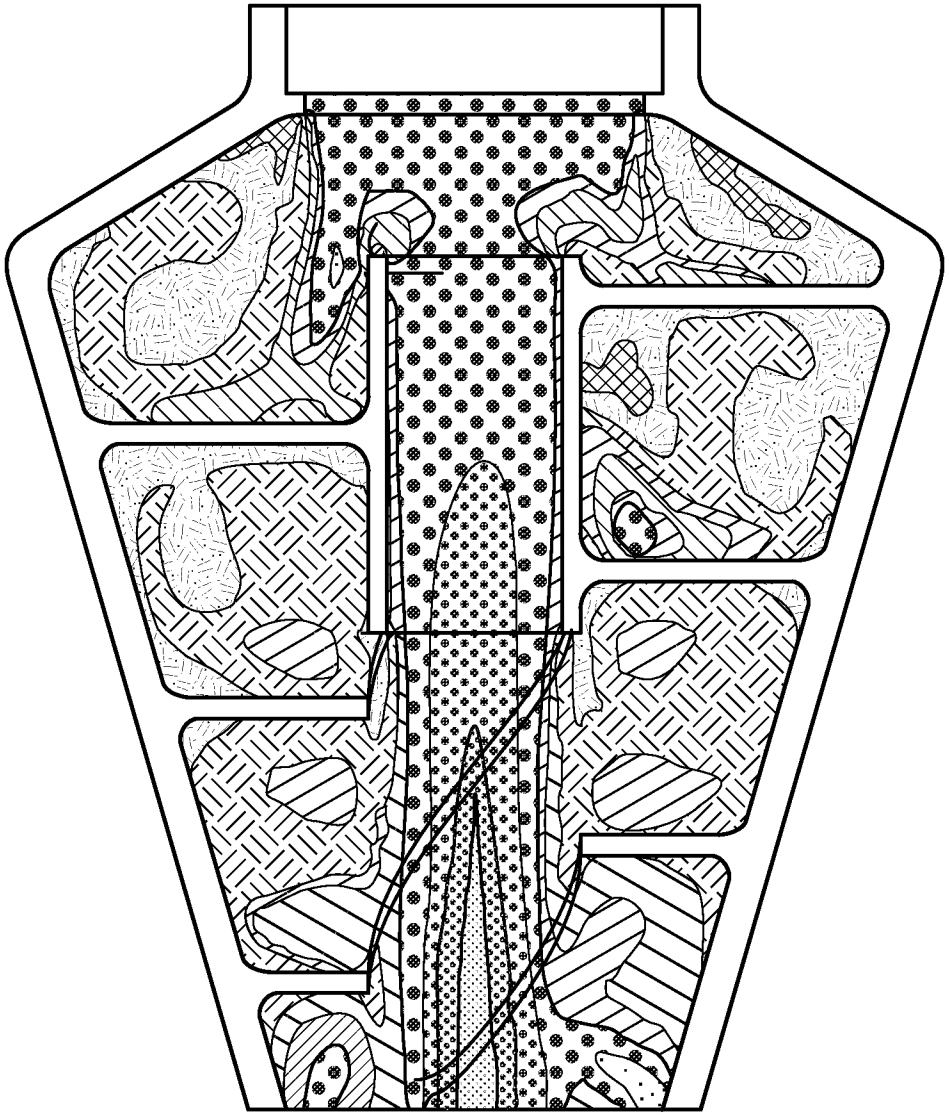
FIG. 7 is a flow model view showing relative fluid flow velocities for a propulsion enhancing device configured in accordance with one or more embodiments of the disclosures made herein.

As depicted by the flow modeling of FIG. 7, a propulsion enhancing device configured in accordance the embodiments of the disclosures made herein (e.g., the propulsion enhancing device 100 discussed above in reference to FIGS. 1-6) serves to transform non-rotational fluid flow (e.g., random straight line flow) generated by the watercraft propulsion unit of a watercraft to rotational flow. As shown, such rotational flow exhibits increased volumetric flow at the fluid flow outlet of the propulsion enhancing device relative to the inlet thereof.

The flow modeling shown in FIG. 7 is based a upon a propulsion enhancing device having a flow expander with an inlet tube that has a four inch (4") inside diameter and a length of one inch (1"). This area equates to nominally 12.5 cubic inches of water. As with the flow expander 105 of the propulsion enhancing device 100, incoming water is separated into three equal volume fluid flow passages defined by flow diverting vanes that wrap around the longitudinal centerline axis of the propulsion enhancing device by about 360 degrees. Each of the fluid flow passages and flow diverting vanes are of a common configuration (e.g., size, shape, volume, length, thickness, pitch, width, etc.). The volume of the bell portion of the flow expander (i.e., from the exit of the flow expander inlet to the entrance into the fluid flow passages) is about 78.5 cubic inches. The central tube of the propulsion enhancing device has length of nominally 4 inches and an inside diameter of nominally 2 inches. These dimensions result in a 6:1 ratio of volume of the bell portion of the flow expander to volume of the flow expander inlet. Advantageously, this ratio provides a balanced load area during water flow levels associated with both low speed operation and high speed operation of an average personal watercraft (i.e., assuming a rider having a weight of about 180 pounds).

As can be seen in FIG. 7, flow amplification in the flow model starts at the end of the central tube. The distance from the end of the central tube to the outlet of the propulsion enhancing device is about 5 inches. The volume within this distance is where rotational flow transpires. In this 5 inch distance, the space between adjacent ones of the flow diverting vanes is open (i.e., not bound by the central tube). Rotational (i.e., vortex) flow provided for by the propulsion enhancing device is concentrated within the propulsion enhancing device. Such rotational flow exits the propulsion enhancing device and portions of the surrounding body of water act as an annulus that maintains the rotational flow profile beyond the propulsion enhancing device. The thrust and torque propulsion afforded by the propulsion enhancing device extends past the outlet of the propulsion enhancing device to a point that depends on the volumetric flow rate (e.g., (gallons per minute—i.e. "GPM") of operation of the watercraft propulsion unit. Advantageously, such point is within the aforementioned annulus that is rearward of the propulsion enhancing device thereby enhancing watercraft stability such as when turning.

In applications where a propulsion enhancing device in accordance with embodiments of the disclosures made herein (e.g., propulsion enhancing device 100) is a discrete article, attachment of the propulsion enhancing device to the water outlet of a watercraft propulsion unit can be achieved by any suitable means. Such means can include, threaded fasteners, chemical bonding, adhesive bonding, welding, threaded engagement interfaces and the like. A sealant can be used at the interface between the propulsion enhancing device and the watercraft propulsion unit to limit leakage therethrough.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A watercraft propulsion enhancing device, comprising:

a flow expander having an upstream end portion adapted for being engaged with a mating outlet portion of a watercraft propulsion unit;

an exterior body having an upstream end portion attached to a downstream end portion of the flow expander, wherein the exterior body tapers from a first cross-sectional size adjacent the upstream end portion thereof to a second cross-sectional size smaller than the first cross-sectional size adjacent a terminal end face thereof and wherein the terminal end face defines a fluid flow outlet of the watercraft propulsion enhancing device;

a central tube having a downstream end thereof located upstream of a terminal end face of the exterior body;

a plurality of flow diverting vanes, wherein each of the flow diverting vanes extends in a helical manner from a first end portion thereof proximate the flow expander to a second end portion thereof proximate the terminal end face of the exterior body; and a plurality of flow passages jointly defined by the exterior body, the central tube and adjacent ones of the flow diverting vanes, wherein each of the flow diverting vanes is attached to at least one of the exterior body and the central tube.

2. The watercraft propulsion enhancing device of claim 1, further comprising:

a plurality of stabilizer fins each extending outwardly from an exterior surface of the exterior body, wherein each of the stabilizer fins has a longitudinal axis extending parallel with a centerline reference axis of the exterior body.

3. The watercraft propulsion enhancing device of claim 2 wherein each of the stabilizer fins is equally spaced away from each adjacent one of the stabilizer fins.

4. The watercraft propulsion enhancing device of claim 2 wherein each of the flow diverting vanes has an interior edge portion exhibiting a uniform effective inside diameter over an entire length thereof.

5. The watercraft propulsion enhancing device of claim 1 wherein each of the flow diverting vanes has an interior edge portion exhibiting a uniform effective inside diameter over an entire length thereof.

6. The watercraft propulsion enhancing device of claim 1 wherein the central tube has a uniform inside diameter over an entire length thereof.

7. The watercraft propulsion enhancing device of claim 6 wherein each of the flow diverting vanes has an interior edge portion exhibiting a uniform effective inside diameter over an entire length thereof.

8. The watercraft propulsion enhancing device of claim 6 wherein the central tube has a generally uniform wall thickness over the entire length thereof.

9. The watercraft propulsion enhancing device of claim 6, further comprising:

a plurality of stabilizer fins each extending outwardly from an exterior surface of the exterior body, wherein each of the stabilizer fins has a longitudinal axis extending parallel with a centerline reference axis of the exterior body and wherein each of the stabilizer fins is equally spaced away from each adjacent one of the stabilizer fins.

10. The watercraft propulsion enhancing device of claim 1 wherein the central tube has an overall length not greater than half the overall length of the exterior body.

11. The watercraft propulsion enhancing device of claim 10 wherein each of the flow diverting vanes extends along an entire length of the exterior body.

12. The watercraft propulsion enhancing device of claim 1 wherein the terminal end face of the central tube is spaced away from the terminal end face of the exterior body toward an upstream end portion of the exterior body by not less than a distance equal to the overall length of the central tube.

13. The watercraft propulsion enhancing device of claim 12 wherein each of the flow diverting vanes has an interior edge portion exhibiting a uniform effective inside diameter over an entire length thereof.

14. The watercraft propulsion enhancing device of claim 13 wherein the central tube has a uniform inside diameter over an entire length thereof.

15. The watercraft propulsion enhancing device of claim 12 wherein the central tube has a uniform inside diameter over an entire length thereof.

16. A watercraft propulsion enhancing device, comprising:

a flow expander having an upstream end portion adapted for being engaged with a mating outlet portion of a watercraft propulsion unit;

a vortex flow generator having therein a plurality of helical flow passages jointly defined by an exterior tubular body of the vortex flow generator, a central tube of the vortex flow generator and adjacent ones of a plurality of flow diverting vanes of the vortex flow generator, wherein an upstream end portion of the exterior tubular body extends from a downstream end portion of the flow expander, wherein each of the flow diverting vanes extends in a helical manner from a first end portion thereof proximate the flow expander to a second end portion thereof proximate a terminal end face of the exterior tubular body, wherein the exterior tubular body tapers from a largest cross-sectional size adjacent the upstream end portion thereof to a smallest cross-sectional size adjacent the terminal end face thereof, wherein each of the flow diverting vanes is attached to at least one of the exterior tubular body and the central tube, wherein a downstream end of the central tube is located upstream of the terminal end face of the exterior tubular body.

17. The watercraft propulsion enhancing device of claim 16 wherein the terminal end face defines a fluid flow outlet of the watercraft propulsion enhancing device.

18. The watercraft propulsion enhancing device of claim 17 wherein:

each of the flow diverting vanes has an interior edge portion exhibiting a uniform effective inside diameter over an entire length thereof; and the central tube has an overall length not greater than half the overall length of the exterior tubular body.

19. The watercraft propulsion enhancing device of claim 18 wherein each of the flow diverting vanes extends along an entire length of the exterior tubular body.

20. The watercraft propulsion enhancing device of claim 19 wherein the central tube has a uniform inside diameter over an entire length thereof.

* * * * *